United States Patent [19]
White
[11] 4,295,608
[45] Oct. 20, 1981

[54] SNOWMAKING NOZZLE

[76] Inventor: Jeffrey A. White, 1 Westmorland Rd., London, Ontario,, Canada, N6J 3N2

[21] Appl. No.: 117,468

[22] Filed: Feb. 1, 1980

[30] Foreign Application Priority Data

Nov. 8, 1979 [CA] Canada ..... 339450

[51] Int. Cl.[3] ..... F25C 3/04; B05B 7/10

[52] U.S. Cl. ..... 239/14; 239/474; 239/488; 239/590.3; 239/590.5

[58] Field of Search ..... 239/2 S, 14, 474, 475, 239/488, 590–590.5

[56] References Cited

U.S. PATENT DOCUMENTS 2,694,603 11/1954 Griffin ..... 239/488
2,786,742 3/1957 McKinley et al. ..... 239/488
3,923,247 12/1975 White ..... 239/14

FOREIGN PATENT DOCUMENTS 2376384 7/1978 France ..... 239/14

*Primary Examiner*—Robert B. Reeves
*Assistant Examiner*—Michael J. Forman
*Attorney, Agent, or Firm*—Frishauf, Holtz, Goodman & Woodward

[57] ABSTRACT

This invention relates to a snow-making nozzle used in the production of artificial snow and which is to be connected to a pressurized supply of water and a pressurized supply of air for the concurrent passage of air and water therethrough. The nozzle has an upstream conically convergent section and a downstream conically divergent section. At the common point of intersection of these two sections, which is normal to the nozzle axis, an annular throat is defined. A restrictor, being a body of revolution, is fixedly positioned in the divergent and convergent sections and includes a conically convergent downstream portion commencing proximate from the annular throat and within the divergent section of the nozzle. The design is conducive to uniform velocity profiles, uniform particle size of snow produced and reduced air-to-water ratios when operating at ambient temperatures approaching the freezing point of water than was previously obtainable in nozzles intended for two phase flow.

6 Claims, 4 Drawing Figures

SNOWMAKING NOZZLE

BACKGROUND OF INVENTION

In my prior U.S. Pat. No. 3,923,247 issued Dec. 2, 1975—Jeffrey A. White, I disclosed a snow-making device employing a typical gun component with a unique nozzle and restricter design. In this prior art construction, a nozzle design for subjecting the non-compressable medium, water, and the compressable medium, air, to a two-stage acceleration experienced at the downstream or horn portion of the nozzle was disclosed. The restricter was made adjustable inwardly and outwardly of the nozzle so as to vary the annular gap between the restricter and nozzle in order to effectively tune the snow-making device for maximum artificial snow production at a given temperature.

In practicing the invention of my prior patent, I have observed that adjusting the restricter inwardly results in a reduction in the two phase flow and additionally, the size of the snow particles produced. Given the relatively small size to weight ratio of these particles, they tend to rise or be blown away from the site intended to be covered with the artificial snow produced by the nozzle. In a like manner, I have also found that a large gap results in an increase in air supply necessary for proper snow production. Where the gap is too large, the nozzle takes on the characteristics of an unrestricted nozzle and its attendant efficiency loss.

One characteristic common to all snow-making equipment is that they are relatively inefficient when producing snow in situations where the device is operating at an ambient temperature of 15°–20° F. and upwards. In this operating range, evaporation of the water particles in the air-water mix is the dominant form of heat removal necessary in order to have the particles freeze. Higher air-to-water ratios are required in this range with an attendant increase in exit velocities from the nozzle. This is because the temperature gradient between the water and the ambient air ($\Delta t$) is relatively small. At lower operating ambient temperatures, $\Delta t$ increases and convection and conduction become the predominant factors in cooling (freezing) the water particles exiting from the nozzle. In this lower ambient temperature range, the ratio of air-to-water can therefore be reduced with a corresponding reduction in exit velocities.

BRIEF SUMMARY OF INVENTION

In accordance with this invention, my novel snow-making nozzle is intended to be connected to a supply of pressurized air and a supply of pressurized water in order to permit the concurrent passage of the two phases therethrough. In my prior patent this was achieved by connecting the nozzle directly to a water jacketed air and water supply gun. Guns of this type can also be advantageously employed with my current nozzle design. It will be evident to those skilled in the art however, that the nozzle of this invention can be suitably used with other existing gun or connector configurations provided the discharge of air and water therefrom (the two phase flow) is intended to pass through a single nozzle.

The nozzle is designed so that the nozzle housing has, relative to the flow direction of air and water passing therethrough, an up-stream connically convergent section and a down-stream connically divergent section which, at their common point of intersection normal to the nozzle axis, defines the nozzle throat. Fixedly positioned within both sections is a coaxial elongate restictor which is a body of revolution and which includes a connically convergent down-stream portion commencing from the nozzle throat to within the conically divergent section of the nozzle.

The disadvantages inherent in adjusting the relative position of the restrictor to the horn or convergent section of the nozzle to suit given operating temperatures or air or water supply pressures (an on site requirement which is often neglected or overlooked by operating personnel), has been overcome by fixedly positioning the restrictor within the nozzle so that the annular gap, as defined between the nozzle and restricter at the throat, is effectively pre-gaged for optimum snow-making efficiency and particle size control. The circumference of the annular gap selected is thus a function of the snow producing capacity (size) of a given nozzle which in turn is predicated upon the supplied quantities of water and air. In a given snow-making system involving set air and water supply pressures, the optimum system capacity employing nozzles of my invention which have a fixed restricter, can be brought to proper operating capacity merely by adding or subtracting more guns of the same or different sizes from the system.

I have also realized that in order to achieve maximum evaporation which, as indicated previously is important at elevated ambient air operating temperatures, a uniform highest possible velocity profile for both air and water is desired. Surprisingly, I have additionally found that a uniform velocity profile has no deleterious effect at lower ambient temperatures (decreased t) and has the very significant advantage of producing a more uniform snow particle size over a wider range of ambient temperatures. This is achieved by discharging the two phases through one localized restriction, the annular gap, and avoiding what may be described as an elongate velocity profile of my prior patented design which had a to produce slower exit velocities and particles of less uniform size. It will also be evident that a single stage restriction as contemplated by this invention imparts less friction on the two phases passing therethrough. This nozzle and restrictor design is also conducive to enhanced nozzle speed of the particles being ejected which are effectively carried by (and partially evaporated by) the discharging pressurized air which is travelling at a higher velocity than the water particles.

In practising this invention, the restrictor which is fixed in position by suitable attachment means may be of a needle-like configuration. However in a different and preferred embodiment of the invention, and in order to maximize the velocity profile of the two phases passing through the nozzle throat, the upstream portion of the restrictor, again relative to the flow direction of the air and water, in the convergent section of the nozzle, is divergent so that the annular area of the restrictor is itself effectively divergent towards the nozzle throat and convergent thereafter. In a two phase flow, such as one composed of air and water passing through an unrestricted tube under pressure at relatively high velocities, there is a tendency for the two phases to separate, with the water going to the outside and air rushing up the middle. Although this is not a problem with smaller snow-making guns, this phenomena is serious in standard capacity guns and generally can only be dealt with by supplying more air for a given amount of water or employing a nozzle design intended to overcome this tendency as taught, for example, in U.S. Pat. No. 3,829,013 —RATNIK issued Aug. 13, 1974 and in my own prior patent where a cross-over of the water issuing through the nozzle was attempted through the development of elongate velocity profiles and effectively, use of a double stage restriction.

Accordingly, and by way of a further embodiment to standard sized nozzles designed in accordance with this invention, the restrictor in the convergent section of the nozzle, which is advantageously made divergent, may also be constructed so as to have radiating therefrom, a plurality of spaced apart vanes which are uniformly angulated relative to the axis of the restrictor and which are circumferentially positioned about the restrictor. In such a construction, the vanes can be usefully used as the support means for maintaining the restrictor in fixed position and serve to further discourage or inhibit separation of the two phases. The flow as it impinges or passes over the vanes is effectively only temporarily rotated and has a tendency to straighten out immediately after passing through the vaned area and the throat.

It will be appreciated that when vanes are employed, on the side of each vane opposite the impinged surface there is a low pressure buildup. In order to deal with this, I have also, as an additional embodiment to my invention where angulated vanes included, made provision for a multiplicity of apperatures or holes in each vane. The angle of the apperatures in each vane relative to the longitudinal plane of the vane is approximate the angle of the vane relative to the axis of the restrictor. These apperatures, I believe, tend to alleviate the pressure differential on either side of the vane and contributes to improved mixing and particle formation. Water sheer or "atomizing" is also experienced at the downstream end of the vanes which itself increases the sheer area in the vicinity of the nozzle throat, which, without the inclusion of the vanes, is simply determined by the circumference of the throat.

Surprisingly, I have also found that when angulated vanes are employed, if too much water pressure is applied to the gun and overrides the air pressure thus making no snow but only water particles, ridges in the exhaust flow pattern instantly become visually apparent. Thus, operators who heretofore had to go out under the pattern to determine if snow is being made, can readily make this assessment from a distance and take the required remedial action.

The cost of generating a supply of compressed air, compared to the cost of maintaining a pressurized water supply, is significant. Air requirements for proper snow production, particularly at temperatures about 15° F. and above also increase markedly. Compared to my prior patented design, nozzles of my present invention have been found to require approximately 15% less air in this range thereby further reducing overall operating costs.

BRIEF DESCRIPTION OF DRAWINGS

In the accompanying drawings which illustrate several different working embodiments of my invention.

DETAILED DESCRIPTION OF DRAWINGS

Figure 1:
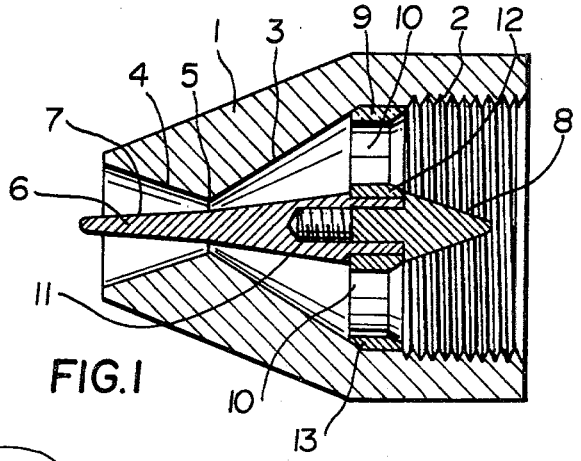
FIG. 1 is a cross-sectional view of the snow-making nozzle with a needle-like restrictor positioned therein.
Figure 2:
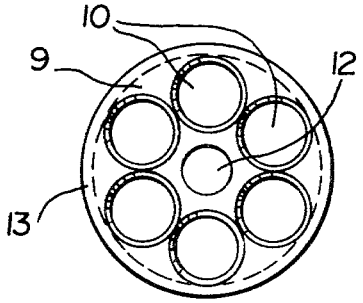
FIG. 2 is a plan view of the restrictor support means of FIG. 1 when viewed from the up-stream end of the nozzle.

With reference to FIGS. 1 and 2, nozzle 1 is intended to be attached at its up-stream end to a gun (not shown) by means of threads 2. The gun itself may be of the type which has an outer water discharge conduit and a coaxial and inner air discharge conduit as disclosed, for example, in my prior U.S. Pat. No. 3,923,247.

The interior of nozzle 1, relative to the air and water flow therethrough has an up-stream conically convergent section 3 and a down-stream connically divergent section 4, which, at their point of intersection in a plane normal to the nozzle axis, define annular throat 5 of the nozzle. Restrictor 6, which is a body of revolution, is positioned within the convergent and divergent sections 3 and 4 of the nozzle and which, characteristically, includes a conically convergent down-stream portion 7 commencing at least approximately in the vicinity of the annular throat 5 within the conically divergent section 4.

In this particular embodiment, and as illustrated, restrictor 6 within convergent section 3 of the nozzle is also conically tapered and effectively complements portion 7. Up-stream of section 3, restrictor 6 includes a conically divergent portion or nose 8. Restrictor 6 is held in fixed position within nozzle 1 by means of support ring 9 (FIG. 2) having a plurality of ports 10 for the passage of air and water therethrough. Restrictor 6, is itself constructed from two parts as shown in FIG. 1 which are threadedly connected to each other at 11 and fixedly secured to ring 9 by extending through central hole 12. The ring and its associated restrictor are held in fixed position within the nozzle by rim 13 of ring 9 being in close complementary engagement with the nozzle interior ae illustrated and the abutment of this ring with gun (not shown) when the nozzle is threadedly connected thereto. It will be apparent, however, that any other suitable means, such as pins, can be employed in connecting the restrictor 6 to nozzle 1.

As best seen in FIG. 1, the nozzle and restrictor makes provision for a relatively sizeable gap or spacing between the restrictor 6 and sections 3 and 4. This is considered important in attempting to have the air and water phases pass through throat 5 with, as far as practicable, uniform velocity profiles.

Figure 4:
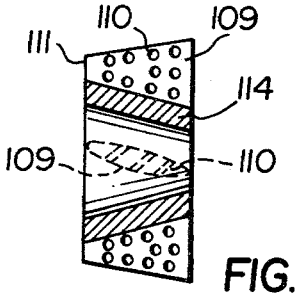
FIG. 4 is a detailed cross-sectional view of the optional vane arrangement forming a portion of the restrictor illustrated in FIG. 3.
Figure 3:
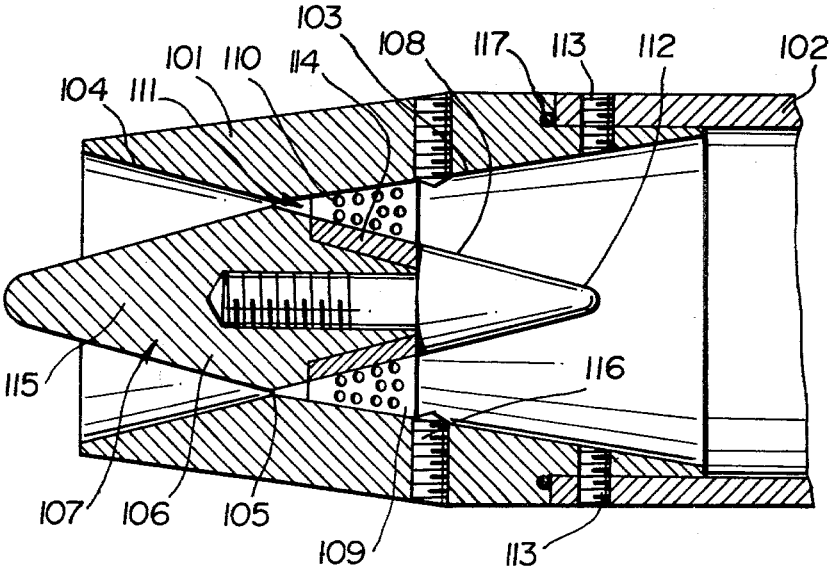
FIG. 3 is a cross-sectional view of a standard size nozzle employing a restrictor of a different design configuration and which shows angulated vanes radiating therefrom which may be optionally employed.

The standard capacity nozzle 101 illustrated in FIGS. 3 and 4 includes a convergent section 103, divergent section 104 and annular throat 105 similar to that shown in FIG. 1. In this particular design, nozzle 101 is connected to the downstream end of the gun 102 by means of set screws or other suitable attachment means 113 with annular seal 117 positioned therebetween. Restrictor 106 includes a downstream conically converging downstream portion 107 and an up-stream conically diverging portion 108 relative to the direction of flow and annular throat 105. As before, this nozzle and restrictor arrangement is conducive to uniform velocity profiles of the two phase flow passing therethrough. Similarly, the restrictor 106 may be held in a fixed position in a manner as discussed in connection with FIGS. 1 and 2. However, in a different embodiment and as illustrated in FIGS. 3 and 4, restrictor 106 is supported by means of a plurality of uniformly spaced apart vanes 109 which circumferentially radiate from portion 108 and which abut section 103 and which in this particular embodiment are shown as being twisted or angulated relative to the nozzle axis.

Set screws 116 in nozzle 101 abut all or selected ones of vanes 109 to thereby hold the restrictor in fixed position. Moreover, and as illustrated, the vanes 109 are provided with a plurality of holes or apperatures 110 which themselves are angulated relative to the longitudinal plane of each vane as seen in FIG. 4. The angle of the holes approximate the angle of offset of each vane relative to the restrictor axis. As there is less pressure on the side of the vanes opposite the sides being impinged by the air and water flow, holes 110 serve to reduce this effect by permitting the passage of air and water therethrough. Trailing edge 111 of each vane constitutes a site for the shear of water passing thereover and effectively increases the available length of water shear surface, which, without the vanes, would be the annular throat circumference.

As illustrated, the restrictor and support for the restrictor is formed from three parts: nose 112 which is threadedly connected to tail 115, and conical ring 114 from which vanes 109 radiate. It will be evident, however, that with suitable modification to the restrictor, a support similar to that of FIG. 2 can be used in place of vane support such as angulated vanes 109.

It is known in the art that deflection vanes positioned in a reducing cone tend to accentuate the spiral effect imparted to the medium passing therethrough when compared to similar type vanes that are located in an expanding cone. In order to capitalize on this phenomenon, when vanes are employed with nozzles of this invention, I prefer to locate them in the reducing cone or convergent section 103 of the nozzle as shown in FIG. 3. The creation of a spiral or vortex-like discharge of compressed air and water particles from the nozzle, particularly at operating ambient temperatures approaching the freezing point, is believed to improve water particle evaporation which is important in freezing the water particles in this temperature range.

What I claim as my invention is:

1. A snowmaking nozzle for use in the production of artificial snow and adapted to be connected to a pressurized supply of air and water for the concurrent flow of air and water therethrough, said snowmaking nozzle comprising a nozzle housing (1, 101) having a nozzle axis;

an elongate tubular passageway in said nozzle housing coaxial with said nozzle axis and which, relative to the flow direction of air and water therethrough, has an upstream conically convergent section (3, 103), a central throat section (5, 105) and a downstream conically divergent section (4, 104);

an elongate restrictor (6, 106) which is a body of revolution positioned in said passageway coaxial with said nozzle axis and which along said nozzle axis is radially spaced apart from said nozzle housing, and having a conically convergent portion (7, 107);

said elongate restrictor being positioned in said passageway, relative to said flow direction, with the conically convergent portion (7, 107) located in said downstream conically divergent section of said passageway, and, a portion of said elongate restrictor also being positioned in said upstream conically convergent section of the passageway, said elongate restrictor being positioned in the passageway such that the widest part of the conically convergent portion is positioned no further downstream than the narrowest part of the cental throat section; and attachment means (9, 109) between said nozzle housing and said elongate restrictor (6, 106) for fixedly positioning said elongate restrictor in said passageway.

2. The snowmaking nozzle as claimed in claim 1, wherein, relative to said flow direction, said restrictor has a conically divergent portion (8, 108) located in said upstream conically convergent section (3, 103) of said passageway.

3. The snowmaking nozzle as claimed in claim 2, wherein said attachment means includes a plurality of spaced-apart vanes (109) circumferentially radiating from said elongate restrictor (106) to said nozzle housing (101).

4. The snowmaking nozzle as claimed in claim 3, wherein said vanes (109) are located in said upstream conically convergent section (103) of said passageway.

5. The snowmaking nozzle as claimed in claim 4, wherein said vanes (109) are uniformly angulated relative to the nozzle axis.

6. The snowmaking nozzle as claimed in claim 5, wherein each of said vanes is provided with a multiplicity of apertures (110).

* * * * *